US007284717B1

(12) United States Patent
Pfaff

(10) Patent No.: US 7,284,717 B1
(45) Date of Patent: Oct. 23, 2007

(54) RECYCLING MACHINE FOR PRECAST CONCRETE PRODUCTS

(75) Inventor: Deems M. Pfaff, Vail, CO (US)

(73) Assignee: Road Processing Resources, Inc., Vail, CO (US)

( * ) Notice: Subject to any disclaimer, the term of this patent is extended or adjusted under 35 U.S.C. 154(b) by 144 days.

(21) Appl. No.: 11/246,481

(22) Filed: Oct. 7, 2005

Related U.S. Application Data

(60) Provisional application No. 60/618,068, filed on Oct. 12, 2004.

(51) Int. Cl.
*B02C 19/00* (2006.01)

(52) U.S. Cl. ..... 241/101.2; 241/101.76; 241/271

(58) Field of Classification Search ..... 241/101.2, 241/283, 270, 271, 101.76
See application file for complete search history.

(56) References Cited

U.S. PATENT DOCUMENTS 5,028,170 A * 7/1991 Gorski et al. ..... 404/72

FOREIGN PATENT DOCUMENTS

EP 0031787 * 11/1980

* cited by examiner

*Primary Examiner*—Mark Rosenbaum
(74) *Attorney, Agent, or Firm*—Steven E. Kahm; Nikolai & Mersereau, P.A.

(57) ABSTRACT

The concrete product recycling machine is transportable to job sites for breaking apart concrete panels and recycling the concrete and the steel reinforcement therein. The concrete panel recycling machine has a conveyor to transport the panels to rest on top of an anvil. The anvil supports the panel for a hammer to engage the panel on the anvil such that the energy imparted by the hammer is reflected by the anvil and breaks apart the concrete panel. Concrete aggregate produced by the hammer fall onto a conveyor thereunder to transport the concrete for recycling. The hammer may traverse the width of the panel to reach all portions of the surface. The steel reinforcement rods can be sawed into manageable and saleable lengths. The steel can be dropped into a container for removal by scrap dealers.

6 Claims, 3 Drawing Sheets

RECYCLING MACHINE FOR PRECAST CONCRETE PRODUCTS

BACKGROUND OF THE INVENTION

1. Field of the Invention

This invention relates to a hammer-anvil principle for fracturing and crushing precast concrete products and recycling the concrete to useable aggregate for new concrete and reinforcing steel as saleable scrap.

2. Description of the Related Art

In the construction industry frequently an old structure must be dismantled before a new structure can be put in its place. The old structure may have had tilt up concrete walls or precast concrete floors or panels. The flat panels of concrete in whatever form must be disposed of by either hauling the panels away to a landfill or a recycling center. It would be easier to recycle the materials on the site if possible by reusing the concrete in the new construction and hauling the steel reinforcing rods to a junkyard or recycling center.

Hauling the concrete-panels to a landfill is not a good option as land fills are expensive and are getting full, plus, concrete panels may not be neatly stacked in the landfill causing gaps which eventually collapse other materials therein after the landfill is finished. Further, the panels have holes in them which over time will cause portions of the landfill to collapse when the concrete breaks down exposing the gaps.

It would be better to recycle the concrete at the building site.

Concrete fabricators having flawed product need to recycle the product and could benefit from having a precast concrete product recycling machine permanently installed on site.

SUMMARY OF THE INVENTION

The precast product recycling machine can be a transportable machine which can be integrated with a flatbed trailer to be placed at a demolition site for processing such things as precast concrete panels, beams and piers for recycling. If there are steel reinforcing rods in the precast concrete products the steel is separated from the concrete. The concrete can be recycled and screened at the site. Otherwise the concrete can be hauled to a concrete recycling facility.

The concrete recycling machine may have a flat bed trailer with a flat area for laying panels or other product on to be recycled. The panels are transported forward onto an anvil positioned on the trailer. The anvil provides a hard backing to reflect the energy from the hammer blows back into the concrete to help fracture the concrete. One or more hammers may be positioned over the concrete product such that the foot of the hammer lands perpendicularly on the concrete panel surface for more efficiently breaking up the concrete. The hammers are housed in a frame, or frames, straddling the panel. The hammer may be a gravity hammer or a powered hammer such as a pneumatic, hydraulic or combination to accelerate the hammer. The anvil is supplied in three components. The direct impact section, a pedestal and a concrete ground pad connected to the pedestal. This configuration isolates residual shock from the operating machine. As the panel is fed over the anvil the hammer fractures and crushes the concrete into aggregate which falls onto a conveyor belt for adding it to a pile of concrete to be further recycled or elevated into a truck for hauling to a recycling facility. If there are steel reinforcing rods in the panels the concrete is removed from the steel rods by shock from hammers and the rods are advanced to a saw, which cuts the steel rods into sections for saleable scarp. The sections of rods can be stored in a container under the trailer and removed when loaded.

The recycling machine for precast concrete product has a high merit for service with concrete fabricators who accumulate faulted product due to voids or damage from handling. The machine on the fabricators site (either mobile or stationary) would permit use of the recycled product thus saving waste costs.

OBJECTS OF THE INVENTION

It is an object of the invention to quickly and easily recycle the materials from manufactured concrete products or demolition of structures.

It is an object of the invention to fracture and crush concrete components into small pieces suitable as aggregate for new concrete and separate the steel reinforcement rods or mesh.

It is an object of the invention to provide a conveyor or a powered means to advance the loaded product to the anvil for a hammer position.

It is an object of the invention to provide a bed for advancing the panel to an anvil.

It is an object of the invention to provide a transportable concrete product recycling machine so that it can be easily hauled to job sites. The operating components can also be fixed in position to process faulted or damaged product at a manufacturing site.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
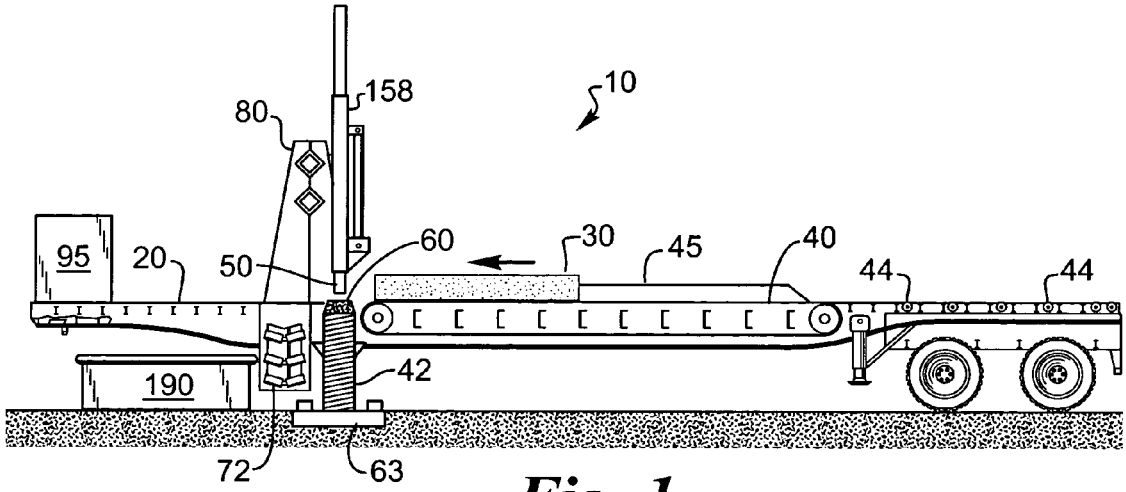
FIG. 1 is a side cross sectional view of the precast concrete product recycling machine on a trailer.

The precast product recycling machine 10 can be mounted on a flat bed trailer 20 such that it can be quickly and easily hauled to a construction site or on a recycling service route.

The principle employed in the precast concrete product recycling machine 10 to reduce concrete products is the hammer-anvil concept which applies shock plus crushing phenomena. The shock applies initially with minor penetration but sets the pattern of breakup. This is apparent by hairline cracks even beyond the hammer face dimension. Further penetration until end of stroke causes separation of product into desired aggregate sizing.

The product to be recycled such as panels 30 are placed on the feed portion of the trailer 20 comprising a feed conveyor 40 and rollers 44 for advancing the panel 30 to an anvil 60, which is placed directly under the hammer 50 axis of motion. The anvil 60 is supported by mounting on a pedestal 42 which contributes to the anvil mass and transmits a residual shock to a ground pad 63. This allows the residual shock to bypass the trailer structure.

The conveyor 40 has sidewalls or guides 45 to align the concrete panels 30 with the hammers 50. The sidewalls or guides 45 are adjustable for the size of the panels 30 and the position of the hammers 50. The hammers 50 can accommodate the width of the panels 30 by use of multiple adjacent hammers 50.

The hammer 50 can be of any type. Typical hammers 50 operate in a frame 158 and are gravity drop, pneumatic, hydraulic or a combination thereof. The hammer 50 has a hammer head 58, which may have a pattern of teeth 59 or a point at the end of the hammer head 58 to help fracture the concrete panel 30 and crush it into aggregate.

There may be more than one hammer 50. In the case where two or more hammers 50 are in operation the hammers 50 take turns hitting the concrete. The hammers 50 taking turns lowers the power requirement of the panel recycling machine since only one hammer 50 is being powered at a time. The hammers 50 are adjacent to each other in frame 158 and together span the width of the panel 30.

The fractured and crushed concrete produced from the panel fall off the anvil 60 and are transported away from the trailer 20 by conveyor 72 to the side of the trailer or elevated into a truck for hauling to a stockpile.

The intensity of the hammer blows are controlled by the velocity of the downstroke of the hammer 50. The thickness and width of the hammers 50 and the hammer head 58 and tooth 59 patterns all effect the fracturing and crushing of the concrete. The conveyor 40 may be moved forward or backward by a machine operator who monitors the recycling machine to have the hammer completely fracture and crush the concrete before more of the panel 30 is introduced to the hammer 50. The operator may also adjust the velocity of the hammer 50.

If the panel 30 has steel reinforcing rods 32 therein a saw 180 may be employed to cut the steel reinforcing rods 32 into sections of 4-5 feet lengths or the entire length of the rods in the panel 30 can be collected and recycled.

The hammers 50 will shed most of the concrete from the steel reinforcing rods 32 and the steel can be dropped into container 190.

The hammer 50 is supported on a frame 158, which supports the hammer head 58 of the hammer 50 perpendicular to the panel 30 for the most efficient transfer of energy from the hammer 50 to the concrete panel 30. The hammer stroke length may be adjusted to accommodate different thicknesses of concrete panels 30 or for the spacing of the steel reinforcement rods 32 in the concrete panels 30.

The hammer 50 may be adjusted for impact force and cycle time as warranted by the panel 30 thickness and other properties.

A power supply 95 such as an engine to drive compressors or pumps to power the hammer 50 and conveyor 40 may also be on the trailer 20.

The controls for the precast concrete product recycling machine 10 are not illustrated but are important to establish limiting in the operations for preventing self-destruction, adjusting for intensity of shock and production rate. Sensors provide input to indicators and a computer to regulate the system actions. The computer responds to a program that can be varied to tailor functions to suit product being processed. Manual and automatic operation is included in system controls.

Figure 2:
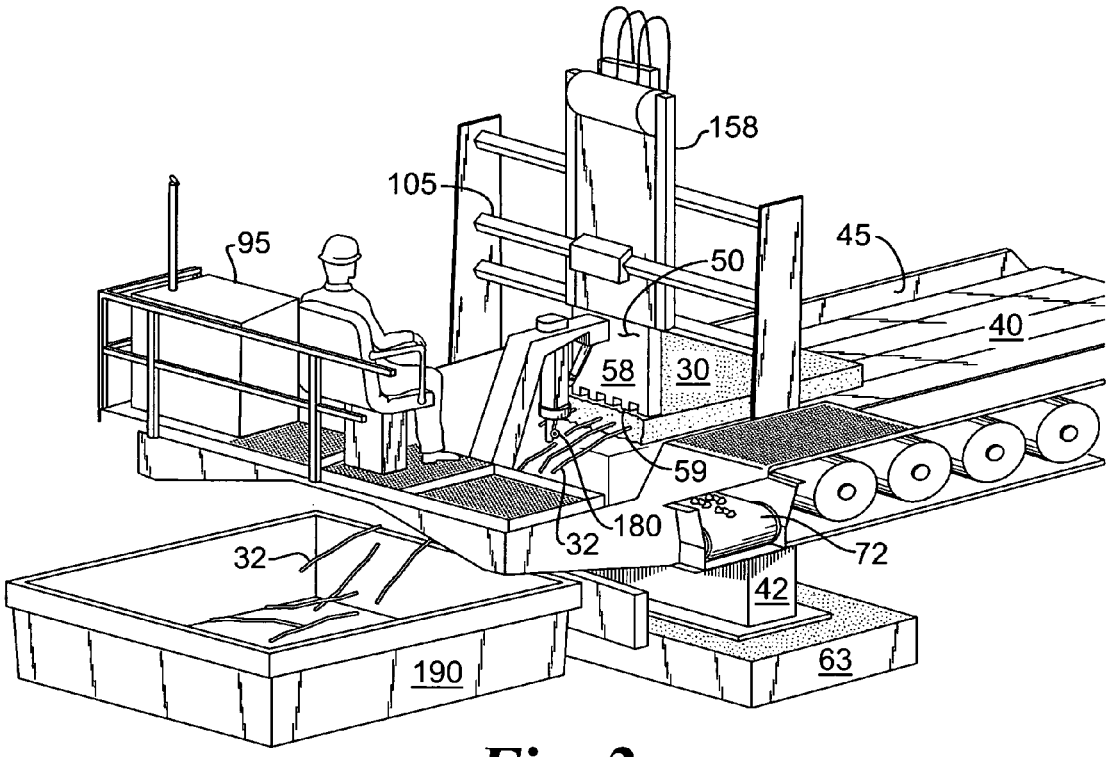
FIG. 2 is a perspective view of the precast concrete product recycling machine in a stationary installation.

The figures each show a slightly different embodiment of the invention. The invention can be integral with a trailer for transportability as in FIG. 1 or fixed in position at one site as in FIG. 2.

Figure 3:
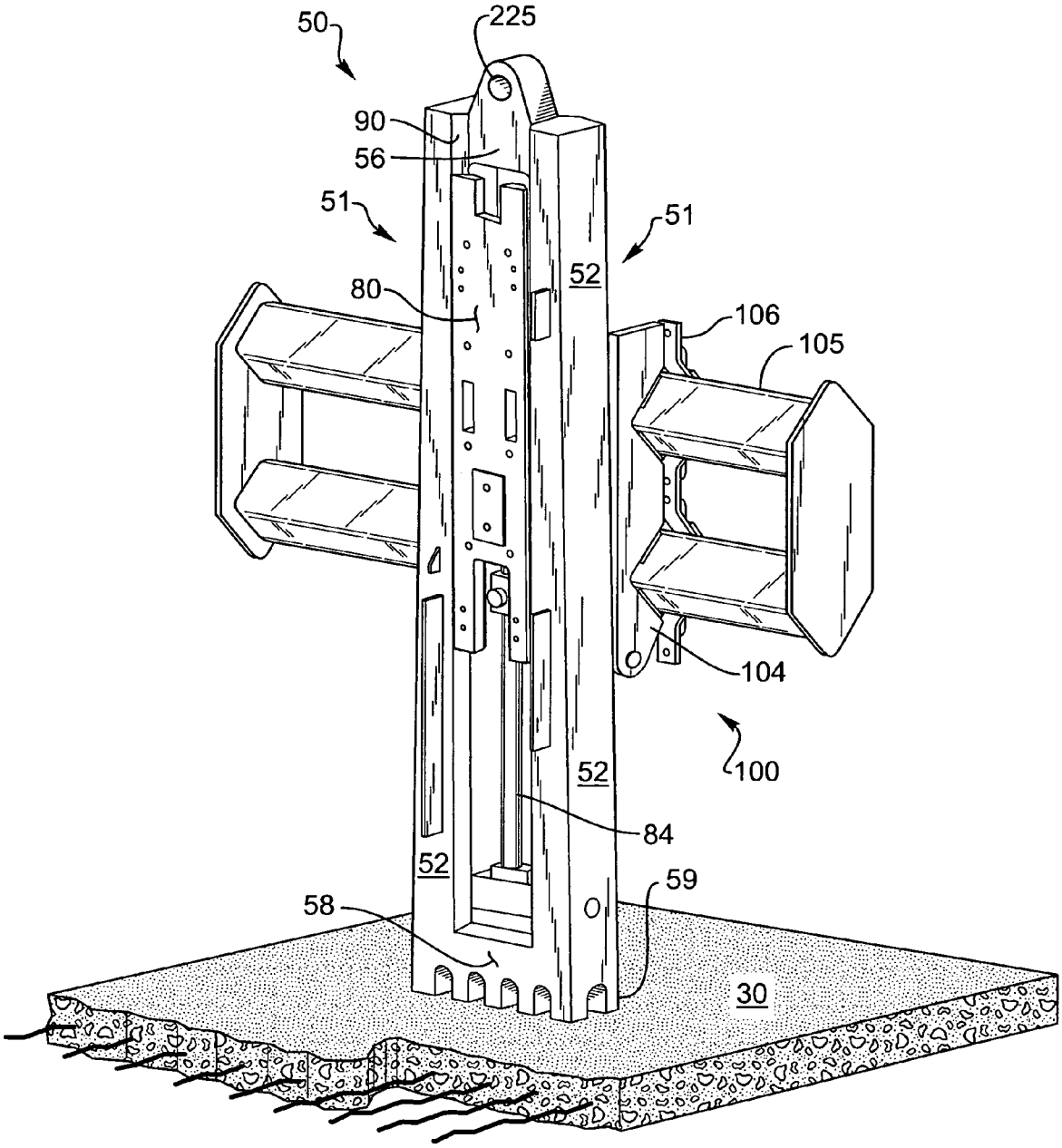
FIG. 3 is a perspective view of a hammer assembly and mounting.
Figure 4:
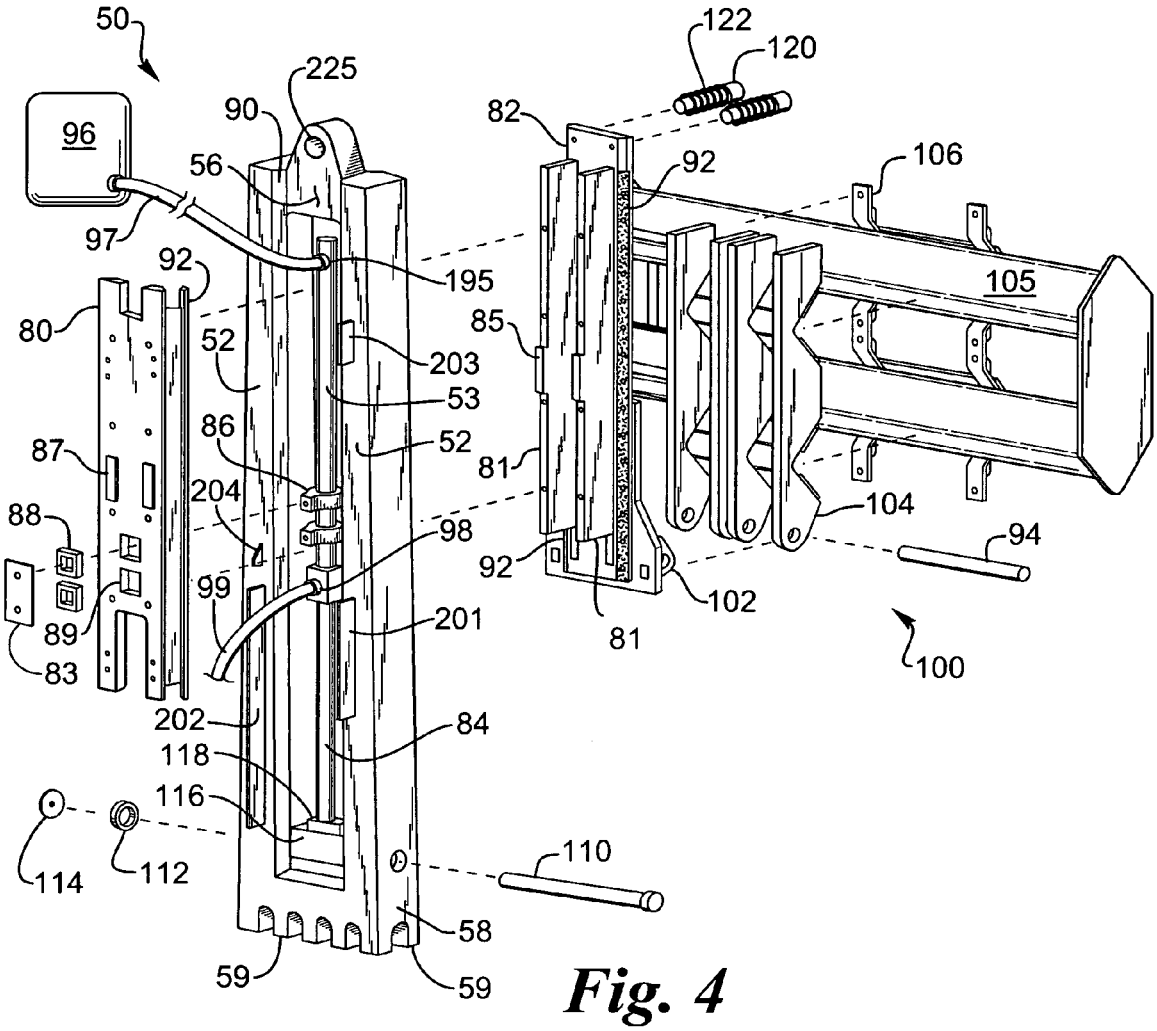
FIG. 4 is an exploded view of a hammer assembly.

In a preferred embodiment the hammer is a hammer assembly 50 as in FIGS. 3 and 4. The hammer mass 51 has a pair of arms 52 connected at the top by a header block 56 and at the bottom by a hammer head 58 with teeth 59. The hammer mass 51 has an angled face 90 along the inside facing edges of arms 52 for engaging the angled face on the guide plate with plastic wear strips 92 on the outer guide plate 80 and the mounting guide plate 82. The guide plates operate on the inside perimeter edges of the arms 52 to keep the hammer aligned straight up and down relative to the guide plates. The angled face 90 along the arms 52 and angled face guide plate plastic wear strips 92 on the outer guide plate 80 and the mounting guide plate 82 are made of a high density plastic which provides smooth slippery surfaces to slide along as the hammer mass slides up and down relative to the guide plates 80, 82 while holding the hammer in place to limit side to side movements which can result in a reduction in the force applied to the concrete. The length of the angled face guide plate plastic wear strips 92 on the guide plates 80, 82 provide for stably holding the hammer mass 51 in place as it slides up and down on the guide plates 80, 82. The angled face guide plate plastic wear strips 90, 92 are preferably at 45 degrees to the face and side of the hammer mass 51.

The outer guide plate 80 has slots for spacers 87 for guide plates lugs 85 on the guide plate spacers 81 of mounting guide plate 82 thus locking the guide plates 80, 82 together to form a guide for stabilizing the hammer mass 51 as it moves up and down. The guide plate spacers 81 provide for the guide plates 80, 82 to surround the cylinder 53 and the piston 84 which is centered within the hammer mass 51. The piston 84 is connected to the hammer mass 51 at the hammer head 58 by a rod connection 110 passing through an aperture in the hammer mass 51 and the base of the piston 116. The pin has a rubber collar 112 to help reduce shock and a retainer 114, which secures the rod connection 110 in place. A cushion 118 can also be used on top of the piston base 116 to help reduce shock between the piston 84 and the hammer mass 51.

The hydraulic cylinder 53 and the piston 84 are centered in the hammer mass 51 which is centered in the guide plates 80, 82 to provide for forces straight up and down without wasted side to side or front and back motions to decrease the efficiency of the hammer 50. The center of mass of the hammer mass 51 is in line with the center of the hydraulic cylinder 53 and piston 84 so that the mass will tend to not tilt or twist the hammer assembly 50 during use which wastes energy and contributes to vibrations and wear.

The hydraulic cylinder 53 has cylinder mounting collars 86 mounted thereon for attaching the outer guide plate 80 thereto. The outer guide plate 80 has apertures 89 for engaging the cylinder mounting collars 86 and cylinder mounting shock absorbers 88 preferably made out of rubber for surrounding the cylinder mounting collars 86 and being between the cylinder mounting collars 86 and the aperture 89. A cover plate 83 keeps the cylinder mounting shock absorbers in place. Hydraulic line 99 connects from a hydraulic pump and to a to hydraulic valve 98 on the hydraulic cylinder 53 to power the hammer retract.

In one mode of operation the hydraulic cylinder 53 is only used to raise the piston 84 up into the cylinder 53 and the hammer mass 51 is then allowed to drop by gravity and hit the concrete to be broken up. The teeth 59 at the base of the hammer head 58 of the hammer mass 51 hits the concrete and first cracks and then breaks up the concrete. The teeth 59 being spaced apart allows space along the surface of the concrete for breaking up the concrete and increasing the shock at the point where the teeth impact the concrete.

The concrete to be broken up is placed on an anvil 60 to increase the shock induced in the concrete by the hammer mass 51. The shock of the hammer blow is reflected by the anvil 60, which helps crack and then break up the concrete.

In another embodiment the cylinder 53 is a duplex cylinder having $N_2$ compressed by the hydraulic lifting of the piston 84 in the hydraulic cylinder 53. The compressed $N_2$ valve 195 and flex hose or piping 97 to reservoir 96 where it stays in compression until needed to accelerate the piston downward to increase the impact of the hammer mass 51 over a gravity drop hammer. When it is desired to increase the impact of the hammer mass 51 valve 195 is opened and the compressed $N_2$ passes from the reservoir 96 through flex hose or piping 97 to the hydraulic cylinder 53 and applies force to the piston to accelerate the hammer mass 51 and increase the impact on the concrete. The hydraulic cylinder 53 thereby stores hydraulic force in the form of compressed gas on the upstroke of the hammer mass 51 to be used later in the downstroke. $N_2$ is the preferred gas in a duplex hydraulic cylinder because it does not have a diesel effect acting with hydraulic oil leakage.

The hammer assembly 50 has a pivotable connection to the mounting plates 104 by a mounting hinge pin 94 through apertures in the mounting hinge and apertures on the guide plate mounting 102. The pivoting of the guide plate 82 allows the hammer mass to be tilted downward for servicing and for transportation. Further, the pivoting is useful for angling the hammer head 58 to be perpendicular to the concrete surface to be broken up. The top portion of guide plate mounting 82 has anti-bind rods 120 for adjusting the angle of the hinge mounting plate 92 and therefore the hammer mass 51. A spring 122 between the anti-bind rod 120 and the hinge mounting plate 92 allows the hammer head 58 and teeth 59 to be angled slightly so as to be easier to lift off the concrete rather then be pinched by or angled into the concrete and thereby be caught and harder to lift out of the concrete. The hydraulic cylinder 53 then expends less energy lifting the hammer mass 51 after it impacts the concrete. The pivot angle for lift out is important when the hammer over a moving conveyor or the concrete moves or slips since the concrete may change position under the hammer when the hammer teeth 59 are imbedded in the concrete.

The mounting bracket 104 is attached by bolting to the hinge mounting plate 92 and to a mounting support 105 which is attached to a frame by brackets 106 to mount the hammer assembly for use on a recycling machine for concrete products or another type of concrete breaking machine.

A plurality of hammer assemblies 50 attached to the mounting support 105 each hitting at different times can efficiently break a wide concrete product apart. In a preferred pattern of hammering there are five hammers first one of the outside hammers 50 hits the pavement then the other outside hammer, then an inside hammer then the other inside hammer and then the center hammer. In this manner first the outside edges are broken then a middle portion and then the center.

For the hammer assembly 50 shown in FIGS. 3 and 4 the hammer mass 51, guide plates 80, 82, and hydraulic cylinder 53 are all positioned to minimize the effects of friction on hammer mass 51 velocity. This is assured by the down stroke of the cylinder piston 84 to be directly in line with the hammer mass 51 center of gravity and guide plates 80, 82 that act parallel and in symmetry with the driven motion. The hammer assembly 50 is mounted on a hinge assembly 100 arrangement that allows the hammer assembly 50 to rotate to a horizontal position for servicing.

The pivoting hinge assembly 100 axis may include shock isolation that is not attenuated by the fracturing process. The linkage pivot may employ rubber rings between bearing races.

Actuator bars 201, 202, 203 and 204 are used in conjunction with sensors, which control the movement of the hammer by computer and valving.

Hoisting eye 225 is used in conjunction with a crane for lifting the hammer mass 51 out of the power hammer assembly 50 or placing the hammer mass 51 in the power hammer assembly 50. Since the hammer mass can be on the order of 2200 kilograms a crane is needed to assemble the power hammer assembly 50 and to replace worn or broken hammers.

Obviously, many modifications and variations of the present invention are possible in light of the above teachings. It is therefore to be understood that, within the scope of the appended claims, the invention may be practiced otherwise than as specifically described.

What is claimed is:

1. A recycling machine for precast concrete products comprising:

an anvil having a top surface, a hammer frame straddling the anvil top surface, the hammer frame holding, at least one hammer having a foot perpendicular to the anvil top surface, a first conveyor for moving a precast concrete product with steel reinforcing rods inside for feeding over the anvil, so that the hammer may strike the precast concrete product such that is cracks and then breaks away the concrete from the reinforcing rods therein, a saw adjacent the anvil for cutting the exposed reinforcing rods after the concrete is removed by the hammer, a second conveyor below and adjacent the anvil for transporting the concrete broken off from the precast concrete by the hammer, a steel rod collection bin adjacent and below the anvil for receiving cut sections of steel rods after they are cut by the saw.

2. A recycling machine for precast concrete products as in claim 1 wherein, more than one hammer attached to the hammer frame, each hammer controlled for striking the concrete at a different time.

3. A recycling machine for precast concrete products as in claim 1 wherein, a pedestal resting on a pad on the ground supports the anvil such that the anvil is solidly supported on the ground.

4. A recycling machine for precast concrete products as in claim 1 wherein, a trailer supports the first conveyor, the second conveyor, the hammer frame, the at least one hammer and the saw.

5. A recycling machine for precast concrete products as in claim 4 wherein, the anvil is supported on a pedestal attached to a pad on the ground.

6. A recycling machine for precast concrete products as in claim 4 wherein, a power supply for operating the hammers is attached to the trailer.

* * * * *